United States Patent [19]

Parikh

[11] 4,180,398

[45] Dec. 25, 1979

[54] MODIFICATION OF LEADED BRASSES TO IMPROVE HOT WORKABILITY

[75] Inventor: Prakash D. Parikh, Hamden

[73] Assignee: Olin Corporation, New Haven, Conn.

[21] Appl. No.: 918,333

[22] Filed: Jun. 22, 1978

[51] Int. Cl.[2] ..... C22C 9/04

[52] U.S. Cl. ..... 75/157.5; 148/11.5 C

[58] Field of Search ..... 75/157.5; 148/11.5 C

[56] References Cited

U.S. PATENT DOCUMENTS

| | | | |
|---|---|---|---|
| 1,350,166 | 8/1920 | Milliken | 75/157.5 |
| 2,046,088 | 6/1936 | Price | 75/157.5 |
| 2,062,426 | 12/1936 | Pierson | 75/157.5 |
| 3,773,504 | 11/1973 | Niimi et al. | 75/157.5 |
| 3,963,526 | 6/1976 | Lunn | 75/157.5 |
| 4,015,982 | 4/1977 | Saito et al. | 75/157.5 |

FOREIGN PATENT DOCUMENTS

| | | | |
|---|---|---|---|
| 1458386 | of 1968 | Fed. Rep. of Germany | 75/175.5 |
| 198579 | of 1965 | Sweden | 75/175.5 |

*Primary Examiner*—L. Dewayne Rutledge
*Assistant Examiner*—Peter K. Skiff
*Attorney, Agent, or Firm*—Paul Weinstein

[57] ABSTRACT

Leaded brasses are modified by additions of chromium, antimony and bismuth in order to reduce the susceptibility of the brasses to edge cracking during hot working. The additional alloying elements also help to maintain the widely known good machinability characteristics of the leaded brasses.

2 Claims, 2 Drawing Figures

MODIFICATION OF LEADED BRASSES TO IMPROVE HOT WORKABILITY

BACKGROUND OF THE INVENTION

Leaded brasses (alloys within the 300 series of the Copper Development Association standard designation) are quite useful for making parts on high speed automatic screw machines. These particular alloys are quite useful because of their very good machinability. This machinability is brought about principally by the addition of lead to the copper-zinc base in the alloy system. Unfortunately, these particular alloys are quite difficult to commercially process because of their inherent poor hot workability. It seems that the material exhibits a large number of edge cracks during hot working and particularly during hot rolling of the alloy into strip material. The incidence of edge cracking during the hot rolling procedure is usually quite severe and thus results in high material loss from the particular strip and subsequent high cost involved in producing the strip.

The leaded brasses, while being quite useful for machining operations, are not particularly noted for their strength properties. Various means have been studied to produce leaded brass alloys which maintain their good machinability characteristics but which also provide a larger amount of useful material when hot worked.

For example, a report entitled "Study on High Strength Free-Cutting Brass for Watch Parts" issued in the annual report of the Engineering Institute of Tokyo University, Volume 22, No. 1 (1963), on Pages 27 to 31 describes the addition of various other elements to a copper-zinc-lead alloy system to improve the strength of the system. This particular article discussed the addition of fourth and fifth elements to the three element based system and the addition of such elements as chromium in particular to such a system. It was found in the study described in the report that chromium moderately increased the strength of the base free-cutting brass alloy system. Various other elements such as titanium and manganese provided the alloy system with a larger increase in tensile strength. U.S. Pat. No. 2,046,088 has disclosed the addition of chromium to those alloys which contain copper, zinc and lead, wherein the lead is apparently limited to approximately 0.01%. This particular patent appears to be mainly concerned with producing improved welding rods which reduce the amount of noxious fumes when utilized in a welding apparatus. Nothing is taught in either reference which suggests the particular alloy system of the present invention.

It is, therefore, a principal object of the present invention to provide a leaded brass alloy system which exhibits increased resistance to edge cracking during hot working.

It is a further object of the present invention to provide such an alloy system which achieves these increases in strength and resistance to edge cracking while maintaining the good machinability characteristics of leaded brasses.

Further objects and advantages of the present invention will become more apparent from a consideration of the following specification.

SUMMARY OF THE INVENTION

The alloy system of the present invention achieves the above-noted objects and advantages by combining a basic copper-zinc-lead alloy system with chromium, antimony and bismuth in such proportions so that the hot workability of the alloy system is enhanced while maintaining good machinability properties. The alloy system of the present invention achieves greatly improved results in edge cracking testing than do representative alloys selected from the leaded brass family of alloys.

BRIEF DESCRIPTION OF THE DRAWING

The drawing consists of two photomicrographs which exhibit the structure of alloys without and with chromium as processed according to the instant invention.

DETAILED DESCRIPTION

The alloy system of the present invention utilizes a basic copper-zinc-lead system as the base to which the modifying elements novel to the present invention are added. The alloy system of the present invention utilizes a basic system of 10 to 40% by weight zinc, 0.1 to 5% by weight lead, balance copper to which is added from 0.03 to 0.75% by weight chromium and from 0.005 to 0.05% by weight for each of antimony and bismuth. Preferably, this alloy is limited to those systems which contain a high proportion of zinc, namely from 30 to 40% by weight. This system should also contain from 0.5 to 3% by weight lead for best results brought about by the other alloying elements. The chromium should preferably be added in amounts ranging from 0.05 to 0.25% by weight. Since the addition of chromium alone tends to degrade the machinability of the alloy system, it is preferred that antimony and bismuth be added to help to counteract this degradation. The antimony and bismuth added to the alloy of the present invention will preferably range from 0.005 to 0.025% by weight for each.

Figure 1B:
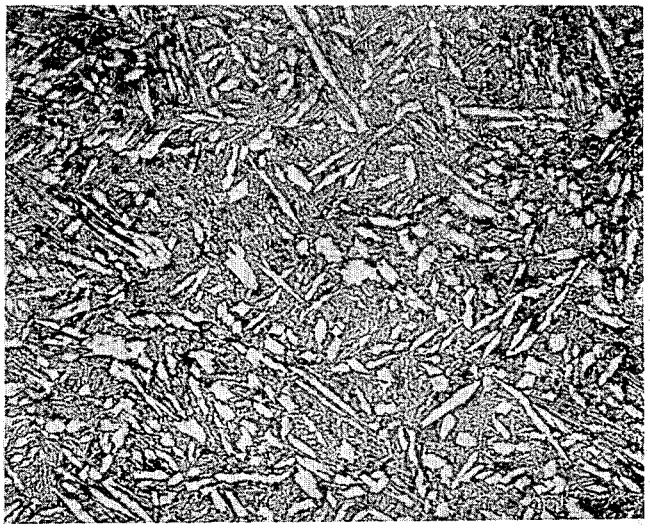
Figure 1A:
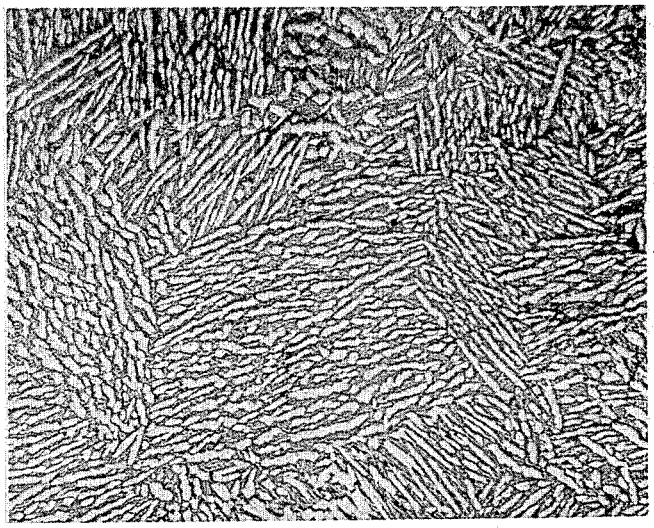

It appears that the chromium addition significantly affects the structure of the alloy which appears to improve the hot workability of the alloy. The drawing figure shows two photomicrographs at a 30× magnification of alloys containing no chromium and chromium (FIGS. 1A and 1B, respectively) of a cast alloy which was hot worked and then quenched. The quenching was utilized to retain as much of the structure developed at the working temperature for room temperature evaluation. The specimens were then etched in a $FeCl_3$ solution and the results are shown in FIGS. 1A and 1B. There is quite a difference in the amount of $\beta$ phase (dark portion) in the alloy and also in the morphology of the phase structures. There is more $\beta$ in the chromium modified leaded brass and the structure of this modified brass appears to have fewer elongated regions than the material shown in FIG. 1A. These two structural features are probably why the chromium modified alloy exhibits good hot workability. Therefore, any addition which increases the amount of $\beta$ and decreases the amount of elongated regions in the alloy structure should improve the hot workability of the alloy.

The alloy system utilized in the present invention may undergo conventional processing as normally utilized for the leaded brasses and the high zinc-containing leaded brasses in particular. While the particular steps of the processing are not important to the present invention, the increase in resistance to edge cracking brought about by the specific alloying elements helps to increase the hot working capability of the alloy system. This in turn enables strip material produced from such an alloy system to undergo further working to produce more useful material from a given slab of cast material.

The alloy utilized in the present invention may undergo hot working, particularly by rolling. The hot worked material may then be cold worked, with or without a specific quenching, again particularly by rolling, either with or without interannealing between cold rolling steps. The maximum cold working between each anneal should be a 70% reduction. The final processing step may be either an annealing step or a cold working step and the annealing-cold working procedure may be accomplished in cycles, with either a cold working or annealing step as the final step of the cycle. This procedure will depend upon what properties are desired in the final product produced from the alloy.

The desirable attributes of the alloy of the present invention may readily be seen from a consideration of the following examples.

EXAMPLE I

Seven alloys with a base composition of 37% by weight zinc and 2% by weight lead, balance copper, were cast under the same conditions in a 6"×4"×1.75" mold as 10 pound castings. The nominal composition of each of these alloys is shown in Table I. The castings were cut into plates having a dimension of 5"×3"×0.8". These plates were machined to give a tapered edge hot working specimen. These specimens were then hot worked after a one hour soaking at the working temperature. Two rolling passes of approximately 20% reduction each were given to the specimens. Hot workability of each specimen was characterized by examining any cracking at the tapered edges. The results of this testing are shown in Table II.

TABLE I

| ALLOY NOMINAL COMPOSITIONS | | | | | |
|---|---|---|---|---|---|
| Number | Zn | Pb | Cr | Sb | Bi |
| 1 | 37 | 2 | — | — | — |
| 2 | 37 | 2 | 0.2 | — | — |
| 3 | 37 | 2 | 0.2 | 0.01 | 0.01 |
| 4 | 37 | 2 | 0.5 | — | — |
| 5 | 37 | 2 | 0.5 | 0.01 | 0.01 |
| 6 | 37 | 2 | — | 0.01 | 0.01 |
| 7 | 37 | 2 | 0.05 | — | — |

TABLE II

| HOT WORKABILITY OF SPECIMENS | |
|---|---|
| Alloy Number | Edge Cracking |
| 1 | Severe |
| 2 | None |
| 3 | None |
| 4 | None |
| 5 | None |
| 6 | Severe |
| 7 | None |

It is quite evident from Table II that both the chromium addition by itself and in combination with the antimony and bismuth has greatly improved the hot workability of the particular alloy specimens.

EXAMPLE II

Hot rolled plates of all the alloys in Example I except for Alloy No. 7 were heat treated at 450° C. for one hour and tested for drill machinability. The test was made by using the machinability rating of 90.0 for Alloy 353 (62% High Leaded Brass) as the machinability standard. These machinability results are shown in Table III.

TABLE III

| MACHINABILITY RATINGS | | | |
|---|---|---|---|
| | Machinability Rating | | |
| Alloy Number | First Test | Second Test | Average |
| 353 | 90.0 | — | 90.0 |
| 1 | 91.7 | 89.3 | 90.5 |
| 2 | 84.0 | 81.8 | 82.9 |
| 3 | 94.1 | 99.3 | 96.7 |
| 4 | 90.8 | 79.8 | 85.3 |
| 5 | 83.5 | 92.6 | 88.0 |
| 6 | 92.9 | — | 92.9 |

In spite of the scattering results by the sum of the first and second tests, it can clearly be seen that the addition of chromium alone tends to degrade the machinability of the base alloy system. It is quite evident that the addition of antimony and bismuth to either a 0.2% chromium modified base (No. 3) or a 0.5% chromium modified base (No. 5) tends to counteract this degradation of machinability and therefore acts as a useful addition to the alloy system.

When the machinability results as shown in Table III are taken in conjunction with the edge cracking susceptibility results as shown in Table II, it becomes quite evident that only those alloy systems which contain chromium, antimony and bismuth added to a copper-zinc-lead base exhibit the desirable combination of good hot workability and good machinability. It is quite clear that while the addition of chromium alone increases the hot workability of the base alloy system, it tends to degrade the machinability of the system. It is also quite evident that while the addition of antimony and bismuth alone (without chromium) to the base alloy system increases its machinability, it has a severe impact upon the hot workability of the system. Therefore, only the alloy system of the present invention provides the desirable combination of these properties to provide an alloy system which is capable of producing more usable material for each unit area of strip produced from the alloy than either the base leaded brass system or a differently modified base system.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. An alloy which exhibits high resistance to edge cracking during hot working, said alloy consisting essentially of 10 to 40% by weight zinc, 0.1 to 5% by weight lead, 0.03 to 0.75% by weight chromium, 0.005 to 0.05% by weight antimony, 0.005 to 0.05% by weight bismuth, balance copper.

2. An alloy according to claim 1, wherein said alloy consists essentially of 30 to 40% by weight zinc, 0.5 to 3% by weight lead, 0.05 to 0.25% by weight chromium, 0.005 to 0.025% by weight antimony, 0.005 to 0.025% by weight bismuth, balance copper.

* * * * *